United States Patent [19]

Magdars et al.

[11] Patent Number: 4,821,370

[45] Date of Patent: Apr. 18, 1989

[54] COMBINATION DRAPERY TRACK AND SIDE WALL MOUNTING BRACKET

[75] Inventors: John T. Magdars, Northbrook; Burton L. Siegal, Skokie, both of Ill.

[73] Assignee: Coral Industrial Sales, Inc., Chicago, Ill.

[21] Appl. No.: 28,348

[22] Filed: Mar. 20, 1987

[51] Int. Cl.[4] ..... A47H 1/04; A47H 1/14

[52] U.S. Cl. ..... 16/94 D; 160/345

[58] Field of Search ..... 16/94 D, 95 D, 96 D, 16/94 R; 160/345, 346; 248/235

[56] References Cited

U.S. PATENT DOCUMENTS

| | | | |
|---|---|---|---|
| 3,278,980 | 10/1966 | Donovan | 16/94 D |
| 3,346,909 | 10/1967 | Blackburn | 16/94 D |
| 3,693,696 | 9/1972 | Salzmann | 16/95 D X |
| 3,916,477 | 11/1975 | Baker, Sr. | 16/94 D |

FOREIGN PATENT DOCUMENTS

| | | | |
|---|---|---|---|
| 1154245 | 9/1963 | Fed. Rep. of Germany | 16/94 D |

*Primary Examiner*—Nicholas P. Godici
*Assistant Examiner*—Carmine Cuda
*Attorney, Agent, or Firm*—Myron C. Cass

[57] ABSTRACT

A single or multiple drapery track and mounting bracket therefor. A cooperating locking latch is provided for mounting the track to the bracket quickly and without using tools. The track has a longitudinal bead along one edge and a dependant wall spaced therefrom. The dependant wall has an outer inclined face having at least one longitudinal notch. The mounting bracket is generally L-shaped, the horizontal leg carrying a downwardly opening curl of size and configuration to receive the bead. The other leg has an inwardly canted strut or tongue of limited resilience. The mounting bracket is first installed on a vertical wall and the longitudinal bead of the support engaged within the curl. The track is pivoted toward the horizontal leg of the bracket forcibly flexing the tongue until it is tightly engaged within the notch. To dismount the track, the tongue is manually flexed until free of the notch and then, the track is pivoted in the reverse direction until free of the bracket.

14 Claims, 1 Drawing Sheet

FIG. 1
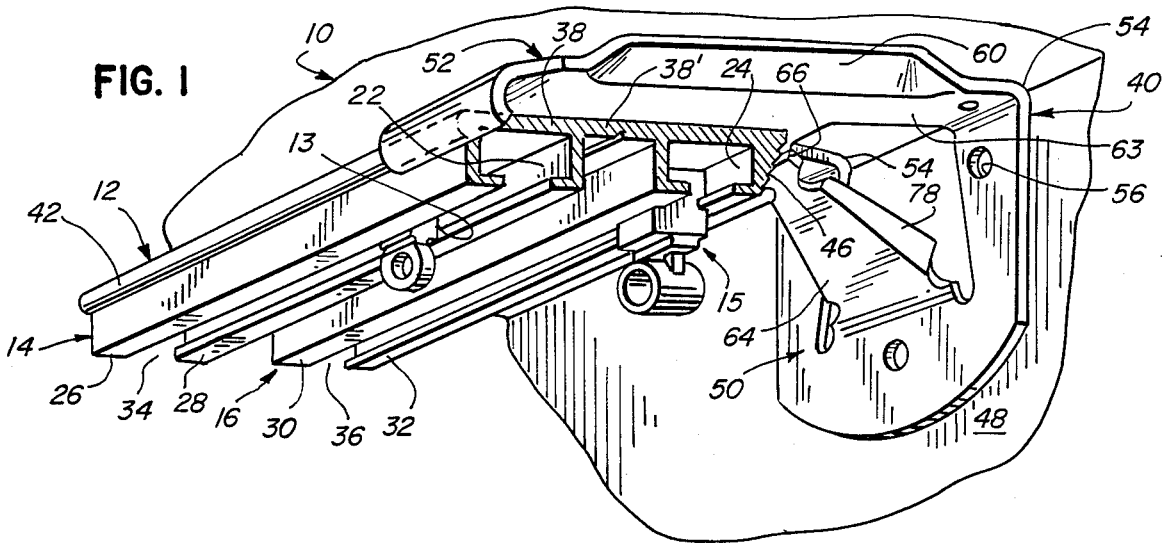
FIG. 2
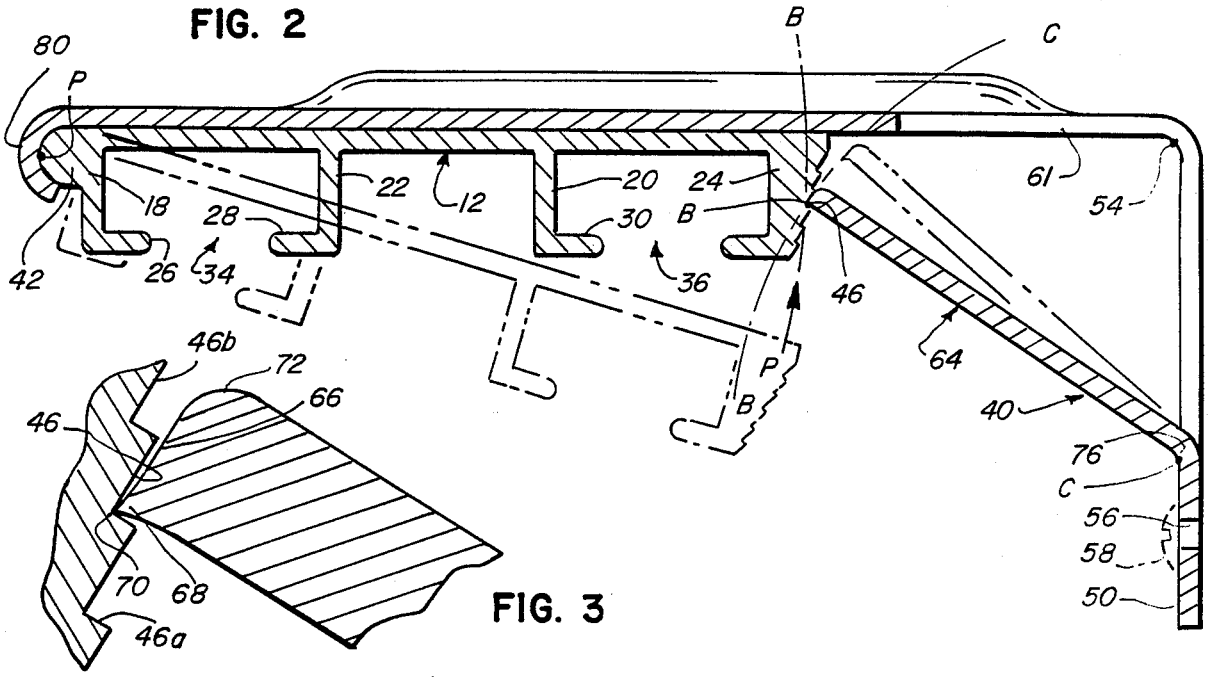
FIG. 3
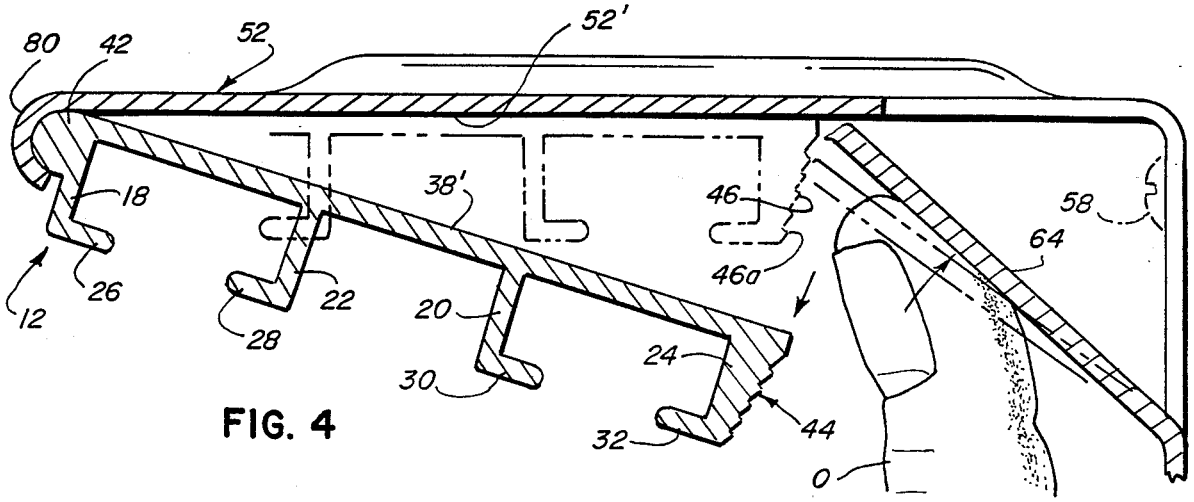
FIG. 4

COMBINATION DRAPERY TRACK AND SIDE WALL MOUNTING BRACKET

BACKGROUND OF THE INVENTION

This invention relates generally to drapery track systems and more particularly provides, in combination, a drapery track and side wall mounting bracket therefor having cooperating snap-in latch means for rapidly engaging and disengaging the track from the bracket without requiring removing the bracket from its installation.

There are many types of drapery support tracks known in the art. Such tracks are generally installed at or near the ceiling of a room to support draperies or room divider panels suspended from the track, for aesthetic and/or utilitarian purposes.

The drapery track may include one or more channels in which carrier members are movable. The drapery panels are provided with pins, hooks, snaps or other suitable fasteners at spaced locations therealong for engagement with the carriers and for supporting the panels from the tracks. The drapery support track may be directly attached to a support surface, as by wall brackets.

Available wall brackets generally include a cantilever member having clamping means to which the support track is secured, generally by manipulation of fastening means. Such members are generally L-shaped and a separate clamp means. Not only must the bracket be fastened to the wall or ceiling, but the drapery support track must be fastened to the clamp part of the bracket assembly. This is time consuming and often dangerous since the installer usually is required to stand at the top of a ladder, hold the track support and manipulate tools, such as at least a screwdriver, to fasten the track to the bracket. Further, the invention provides a mounting bracket for a drapery track which includes a novel load support strut which greatly rigidified and strengthens the bracket while under the load of a drapery track with suspended drapery panels. If the bracket location must be changed, the track must be disengaged from the bracket thus encountering the same difficulties as during installation. Thus, there is a recognized need for a safer and more improved mounting bracket and track combination which will enable the track to be more easily and rapidly engaged and disengaged.

SUMMARY OF THE INVENTION

There is provided a drapery track having at least one channel for slidably receiving carrier members for supporting drapery panels, said track having opposite parallel longitudinal faces, the mounting bracket and track having cooperating means for releasably mounting said track in a snap-in connection. In particular, a longitudinal bead is provided along one longitudinal face of said track and a conforming socket for receiving the bead is formed on the mounting bracket. An elongate longitudinal notch is formed along the opposite face of said track and support strut or tongue of limited resilience is integral with the bracket, which is engagable within the notch in a snap-in connection for rigidifying and strengthening the assembled components.

BRIEF DESCRIPTION OF THE DRAWINGS

FIG. 1 is a perspective view, partially in section, of a drapery track and mounting bracket therefor according to the invention and illustrated installed on a wall;

FIG. 2 is a transverse sectional view taken through the drapery track and mounting bracket assembly of FIG. 1 and illustrating the track in the process of being installed in phantom outline;

FIG. 3 is an enlarged fragmentary sectional detail of the snap-in connection between the strut and track according to the invention; and FIG. 4 is a transverse sectional view of the drapery track and mounting bracket of FIG. 1 illustrating the track in the process of being disengaged from the bracket at said snap-in connection.

DESCRIPTION OF THE PREFERRED EMBODIMENTS

Referring to FIG. 1, the drapery track and mounting bracket therefor embodying the invention is designated generally by reference character 10. The drapery track 12 preferably is formed as an elongated extrusion which may be of any desired length. The track 12 is of a generally rectangular cross-sectional configuration and includes at least one channel formation. Suitable albeit slightly different types of drapery carrier members 13, 15 are illustrated slidably received within tracks 14 and 16 respectively for supporting fasteners such as pins eyelets and the like secured along the upper edge of draperies in a conventional manner. In the illustrated embodiment, a pair of depending channel formations 14, 16 are shown extending along the length of track 12. The channels 14, 16 are defined by parallel outer facing side walls 18, 20 and respective parallel inner facing walls 22, 24 associated with a respective adjacent outer facing side wall. Each respective adjacent side wall 18, 20 and 22, 24 is formed with a right angle flange 26, 28 and 30, 32 respectively. The flanges 28 and 26 are opposite each other and spaced apart to provide the elongated gap 34 in the channel 14. The flanges 30 and 32 likewise are opposing and spaced apart to provide the elongate gap 36 into channel 16. There is a transverse wall 38 across the width of the track 12 and opposite the gaps 34 and 36 thereby closing the said channels. The channels 14 and 16 are separated from each other by the intermediate segment 38' of transverse wall 38. The carriers 13 and 15 are slidably in the respective channels supported on said flanges or ledges.

Each of the side walls 18, 24 of track 12 is provided with means on an outer face thereof for releasable engagement with selected elements of the mounting bracket 40. The side wall 18 is provided with a longitudinal bead 42 extending along the length of the side wall 18. The bead 42 is of uniform geometric shape, preferably convex in configuration. The side wall 24 has an outer face 44 formed with at least one elongated longitudinal notch 46 defining a seat, preferably angled inwardly toward the side wall 18 and coextensive with said side wall 24.

The mounting bracket 40 is formed preferably of relatively heavy guage metal by stamping and comprises an integral body having a generally L-shaped cross sectional configuration with a first leg or segment 50 joined with a second leg or segment 52 along folds 54. The segment 50 is adapted to be secured to the vertical surface 48 and can be provided with apertures 56 for receiving suitable fasteners 58. The second segment 52 is horizontally oriented and adapted to overlie the wall 38 of track 12. Segment 52 includes side marginal areas 60 which are curled upwardly to provide additional strength.

The strut or tongue 64 is formed during the stamping process forming mounting bracket 40 by striking the tongue from the segments 50 and 52, leaving a cut-out portion 61 and connecting portion 63 carrying folds 54. The strut 64 is canted in the direction of the second segment 52 so that an angle of from 25° to 50° is defined between the strut 64 and the plane of the second segment 52. The strut 64 has a free end 66 extending toward but spaced from the second segment 52.

The stamping process forms a burr 68 along the free end 66 of the tongue 64 so as to form a sharp edge 70 and a curl or smooth edge 72 which effectively minimizes the loss of effective bearing area occasioned by reducing the length of the contact area of the free end 66 such as by reducing the length of the surface 46*b* of notch 46. The tongue 64 is of limited resilience capable of being flexed toward the second segment 52 along an ar BC without reaching the elastic limit of the metal at the juncture 76. Point B is located at the rest location of the burr 68 of tongue 64 in notch 46 after installation. Point C is located at the junction 76 of the tongue 64 and segment 50. The tongue 64 is provide with sidewings 78 to eliminate the likelihood that the drapery panel will snag against the sharp edge 70 of the tongue 64.

The second segment 52 of mounting bracket 40 is formed with longitudinal curl 80 at its free end, the curl being capable of engaging the bead 42 formed along the wall 18 of track 12. The curl 80 preferably has a curvature generally conforming to the curvature of the bead 42 so that the latter can be fitted within the curl 80 and define a pivot P for swingable engagement with the bead 42 during installation of the track 12. The engagement of the curl and bead is sufficiently secure to provide support for the track 12 along one side thereof.

The first step in the installation of the track 12 is to insert bead 42 within curl 80 and the rotate track 12 to pivot the same about the point P along an arc PB until the wall 38 is parallel to under surface 52′ of the second segment 52 of mounting bracket 40. During the course of travel of the track 12 about pivot point P and along the arc PB, the free end 66 of the tongue 64 engages the face 44 of wall 24 and is urged thereagainst, causing the tongue 64 to flex toward the second segment 52 along arc BC until the sharp edge 70 engages fully within the notch 46. When the tongue 64 and the notch 46 are so interengaged, the wall 38 of track 12 engages the undersurface 52′ of the second segment 52 of bracket 40. The track 12 is seated with the sharp edge 70 engaged fully in notch 46. The tongue 64 tends to be biased in the opposite direction of its flexing motion, and hence digs into the notch 46. Any tendency of the track 12 to pivot in an opposite direction due to a load carried thereby is prevented since the tongue 64 also tends to pivot in the same direction, effecting a tighter engagement of tongue 64 within notch 46.

The outer face 44 of wall 24 can be provided with plural longitudinal auxiliary notches 46*a* parallel to notch 46 to provide as many increments as practically possible so as to compensate for possible variation in tolerances which may be encountered in forming the track 12.

For cleaning, repair, replacement or other purposes, the track 12 may be selectively disengaged from mounting bracket 40 with dismounting the bracket. As shown in solid line in FIG. 4, an operator O, can apply moderate pressure force against the tongue 64 in the vicinity of the free end 66 to flex the same upwardly toward segment until the sharp edge 70 clears the notches 46. The track 12 is pivoted along arc BP in a direction away from the segment 52 until released from the curl 80.

The invention is capable of considerable variation in structure, arrangement and size of various components by those skilled in the art without departing from the spirit or scope of the invention as defined in the appended claims.

We claim:

1. A drapery track and mounting bracket therefor;

(a) said track comprising an elongated member of generally rectangular cross-sectional configuration and having at least one channel formation extending the length thereof, said channel having means for slidably receiving drapery carrier members therein including first and second, spaced outer side walls, a first outer side wall including a bead on the outer face thereof, and a second side wall including at least one longitudinal notch formation on the outer face thereof; and (b) a mounting bracket for said track comprising, a generally L-shaped body having a first segment adapted to be attached to a vertical support surface and a second segment adapted to overlie said track, said first segment including track retention means comprising a resilient tongue extending upwardly from said first segment toward said track for selectively engaging said notch formation in said track in a snap fit connection, said second segment having a free end including a curl formation engageable with said bead.

2. The combination as defined in claim 1 wherein said second side wall is angled inwardly toward said first outer sidewall.

3. The combination as defined in claim 1 wherein said means comprises a tongue integral with said first segment which defines an angle in the range of about 25° to 50° with the plane of said second segment of the mounting bracket.

4. The combination as defined in claim 1 wherein said notch opens outwardly and is formed as a step having a pair of walls meeting at a sharp intersection.

5. The combination as defined in claim 4 wherein there is a plurality of stepped notches arranged parallel longitudinally along said second outer sidewall.

6. The combination of claim 1 in which said curl and bead define a pivot coupling respectively.

7. The combination of claim 6 in which said bead extends substantially the entire length of the track and is arranged to be engaged with the aligned curls of a plurality of like mounting brackets.

8. The combination as defined in claim 6 wherein said curl has a generally concave cross-sectional configuration.

9. The combination as defined in claim 6 wherein said bead is of a generally convex cross-sectional configuration.

10. The combination as defined in claim 1 wherein said means comprises a tongue integral with said first segment and having a free end engageable within said notch formation.

11. The combination as defined in claim 10 in which said free end of the tongue has a burr formed thereon to provide a sharp edge for engaging fully within said notch.

12. In combination:

(a) a drapery support device comprising an elongated member of generally rectangular cross-sectional configuration and having structure defining a select number of channel formations extending the length thereof, said channel formations having means for receiving a plurality of individual drapery carrier members therein, structure including first and second, spaced apart outer sidewalls with said select number of channel formations therebetween, said first sidewall including a longitudinal bead having a select cross-sectional configuration on an outer face thereof and said second sidewall including an outer face angled inwardly toward said first sidewall and having at least one longitudinal notch therein;

(b) a mounting bracket for said drapery support device comprising a body of generally L-shaped cross-sectional configuration, said bracket having a first segment adapted to be attached to a vertical support surface and a second segment adapted to overlay a rear wall of said drapery support device, said first segment including a canted tongue integral with and struck from said first segment having limited resilience and extending toward and spaced from said second segment with a free end for engaging within said longitudinal notch, said second segment including an inwardly bent curl on an outer end thereof, said curl having a cross-sectional shape generally corresponding to that of said bead.

13. The invention of claim 12 in which said second segment outer end is generally hook shaped.

14. The invention of claim 12 in which said free end of the tongue is releasably engaged against said second sidewall.

* * * * *

UNITED STATES PATENT AND TRADEMARK OFFICE

CERTIFICATE OF CORRECTION

PATENT NO. : 4,821,370

DATED : April 18, 1989

INVENTOR(S) : John T. Magdars and Burton L. Siegal

It is certified that error appears in the above-identified patent and that said Letters Patent is hereby corrected as shown below:

Column 3, line 22, delete "ar" and insert --arc--;

line 26, delete "provide" and insert --provided--.

Signed and Sealed this

Thirty-first Day of October, 1989

*Attest:*

DONALD J. QUIGG

*Attesting Officer*

*Commissioner of Patents and Trademarks*